United States Patent [19]

Mader

[11] 4,346,682

[45] Aug. 31, 1982

[54] CARBURETOR FOR A MULTICYLINDER INTERNAL COMBUSTION ENGINE AND METHOD OF OPERATION THEREOF

[75] Inventor: Reinhard Mader, Reisgang, Fed. Rep. of Germany

[73] Assignee: Bayerische Motoren Werke, Munich, Fed. Rep. of Germany

[21] Appl. No.: 125,664

[22] Filed: Feb. 28, 1980

[30] Foreign Application Priority Data

Feb. 28, 1979 [DE] Fed. Rep. of Germany ..... 2907812

[51] Int. Cl.[3] ..... F02M 23/04

[52] U.S. Cl. ..... 123/179 G; 123/527; 261/39 D

[58] Field of Search ..... 123/575–578, 123/525, 179 G; 261/39 D

[56] References Cited

U.S. PATENT DOCUMENTS

| | | | |
|---|---|---|---|
| 3,934,571 | 1/1976 | Mennesson | 123/179 G |
| 4,019,477 | 4/1977 | Overton | 123/179 G |
| 4,106,464 | 8/1978 | Yamashita et al. | 123/588 |
| 4,172,436 | 10/1979 | Mennesson | 261/50 A |

*Primary Examiner*—Charles J. Myhre
*Assistant Examiner*—E. Rollins Cross
*Attorney, Agent, or Firm*—Craig & Antonelli

[57] ABSTRACT

A carburetion arrangement and method of carburetion for a multicylinder internal combustion engine wherein at least one carburetor acts as a main mixture forming device with the main mixture being guided through individual intake lines which connect the carburetor to intake valves of the engine. Further mixture components are guided through separate air and fuel lines which terminate in the individual intake lines with the separate air and fuel lines being combined immediately before the intake lines. The intake air is supplied to the further mixture components primarily through the individual intake lines with a volume controlled portion of the intake air of this mixture component, reduceable to zero, being guided through the separate air lines, as correction air for the fuel to the mixture components flowing through the separate fuel lines. The correction air flowing through all the lines is controlled volumewise by a common control device which is disposed upstream of an air distributor for the air lines. The fuel is fed to the separate fuel lines commonly and at zero pressure from the carburetor as well as to individual inlets in the respective intake lines by way of a fuel throttle nozzle located in a vicinity of the individual inlets.

25 Claims, 3 Drawing Figures

CARBURETOR FOR A MULTICYLINDER INTERNAL COMBUSTION ENGINE AND METHOD OF OPERATION THEREOF

The present invention relates to internal combustion engines and, more particularly, to a carburetor for multicylinder internal combustion engines and a method of operating such carburetor.

In German Offenlegungsschrift 26 13 679, a carburetor is proposed for avoiding separation of the mixture of mixture components in long mixture lines with all of the mixture components for idle operation being guided through separate air and fuel lines and with their total volume and mixing ration being determined at the inlet by means of an idle adjusting screw.

When unilizing a carburetor such as proposed in the aforementioned German Publication with a multicylinder internal combustion engine, a plurality of adjusting screws are required thereby resulting not only in a high manufacturing cost but also resulting in nearly insuperable problems of adjustment of the carburetor for maintenance. Moreover, the distribution of the fuel mixture to the individual cylinders after the mixture components have been brought together would once again result in the disadvantage of separation of the mixture as described in the German Reference. Furthermore, the proposed carburetor does not have a volume and mixture control which is automatically adjustable during the operation of the internal combustion engine but merely a setting means which can be fixed in the correct position for the engine when the engine has warmed up.

The aim underlying the present invention essentially resides in providing a carburetor and a method of operating the same wherein fuel-air mixture components are brought together near the intake valves of an internal combustion engine without requiring multiple control devices at the mixing points and wherein a central variable mixture control for different variable operating states of the internal combustion engine is permitted.

In accordance with advantageous features of the method of the present invention, at least one carburetor is provided which acts as a main mixture-forming device with the main mixture being guided through individual intake lines which connect the at least one carburetor to the intake valves of the engine. Further mixture components are guided through separate air and fuel lines which terminate in the individual intake lines, with the separate air and fuel lines being combined immediately before the intake lines. The intake air is supplied to the other mixture components primarily through the individual intake channels with a volume-controlled portion of the intake air of this mixture component, reduceable to zero, being guided through the separate air lines, as correction air for the fuel, to these mixture components as correction air for the fuel flowing in through the separate fuel lines. A common control device is provided for controlling the volume of the correction air flowing through all of the air lines with the common control device being disposed upstream of the air distributor for the air lines and the feeding of the fuel to the separate fuel lines commonly and at zero pressure from the carburetor as well as to the individual inlets in the intake lines through a fuel throttle nozzle located in their vicinity.

By virtue of the above-noted features of the present invention, it is ensured that, despite central control of the mixture components which is more favorable from the cost and maintenance standpoints, these mixture components are mixed precisely directly at the individual inlets to the individual intake pipes of the internal combustion engine. In this menner, even unstable operating states can be compensated for by an appropriate construction of the control devices with relatively low construction costs such as, for example, with a conventional carburetor which contains these control devices and from which separate air and fuel lines each pass through a distributor to the individual inlets of the intake pipes.

By supplying most of the intake air through the individual intake pipes and the fuel as well as the correction air in separate lines in accordance with the present invention, not only is an idle operation of the engine allowed with the engine being warmed up but also operating states requiring enrichment such as starting, warm up, and acceleration are allowed with a uniform mixture formation. Consequently, an internal combustion engine provided with the carburetor operated in accordance with the method of the present invention exhibits especially good fuel consumption, exhaust gas composition, and performance.

In accordance with further advantageous features of the method of the present invention, the zero pressure fuel supply from the carburetor is shut off as a function of an enrichment signal and, at the same time, fuel is supplied to the individual inlets of the intake pipes under pressure from a fuel pump. By virtue of these features, the separate fuel lines are additionally used for enrichment of the mixture accomplished by the pump pressure as, for example, in enrichment for acceleration of the internal combustion engine.

In accordance with the present invention, at least one carburetor is provided which functions as the main mixing-forming device with individual intake channels connecting the carburetor and the intake valves of the engine and with separate air and fuel lines terminating at the individual intake channels which air and fuel lines combine in each case upstream of the intake lines. The control device such as, for example, a cold start valve and an air valve is provided which distributes commonly, controlled as a function of volume, most of the intake air for the mixture components formed by the separate air and fuel lines to the individual intake channels in a vicinity of the carburetor. At least one additional control device such as, for example, a correction air valve is provided for a small portion of the above-noted intake air. The control device controls the intake air to the individual air lines as fuel correction air as a function of the volume which is reduceable to zero and the device is located upstream of the air distributor or the separate air lines. A fuel distributor is provided for the separate fuel lines which distributor is connected at zero pressure to the carburetor.

In accordance with further features of the present invention, the control device fashioned as a cold start valve and a coupled correction air valve is constructed so that the valve increasingly opens a control cross section for the correction air as the engine operating temperature rises.

Advantageously, the cold start valve may include an additional air valve which valve increasingly throttles the control cross section as the operating temperature rises. The valve may act as a control device for the volume intake air supplied to the intake channels.

Advantageously, the control device and the additional control device of the present invention may be formed by a cold start valve disposed in the carburetor with a system of lines and throttle nozzles as well as a single air valve, which air valve increasingly throttles a control cross section in a bypass channel to a throttle plate of the carburetor as the engine operating temperature rises, whereby the bypass channel has a throttle point in the vicinity of its input and has between the throttle point and air valve a branch provided with a throttle nozzle for separate air lines.

Additionally, in accordance with the present invention, an additional throttled air channel terminates in the branch with the inlet of the air channel being located parallel to the input of the bypass channel.

By virtue of the above-noted features of the present invention, an advantageous solution for mixture control during warm up of the internal combustion engine is realized. Additionally, by forming the control device and additional control device as a cold start valve, an advantageous solution is realized wherein a single air valve serves both as a control device for the principle components of the intake air and for the correction air as well.

To provide for an enrichment control of the mixture for certain operating stages of the internal combustion engine which enrichment control cooperates with the throttle valve or plate of the carburetor, in accordance with the present invention, at least one additional throttled correction air line terminates upstream of the air distributor with the line being connected in the carburetor immediately upstream or downstream of the throttle valve or plate at a point which is swept by the throttle valve or plate.

In order to determine the basic setting for the correction air volume during a steady idle operation, in accordance with the present invention, a throttle adjustment screw may be provided in an aircollecting line as a further device.

According to the present invention, an air shut off valve may be disposed in the air collecting line which valve is controlled by an electric circuit of a starter and serves as an additional control device. By providing an air shutoff valve as a further control device for the correction air, it is possible for the shut off valve to shutoff the correction air to enrich the mixture on starting, during the starting procedure, and possibly thereafter with the use of a timing circuit.

Fuel enrichment during acceleration is made possible in accordance with the present invention in an extremely simple manner by connecting a conventional accelerator pump to the separate fuel lines. Preferably, the conventional accelerator pump is mechanically connected to the throttle valve or plate and is connected in or parallel to the common connecting or fuel collecting line of the separate fuel lines from the carburetor.

In order that the zero pressure fuel supply from the carburetor may be shutoff as a function of the enrichment signal and at the same fuel may be supplied to the individual inlets of the intake channels under pressure from a fuel pump, in accordance with still further advantageous features of the present invention, a fuel shutoff valve may be located in a common connecting line of the separate fuel lines with the connecting line being connected with the pressure side of a fuel pump through an additional fuel shutoff valve, and with the two shutoff valves being alternately actuated depending upon the position of an enrichment switch. By virtue of this arrangement, the separate fuel lines can be used alternatively for intake operation normally and for enrichment during acceleration when pressurized by a fuel pump.

The carburetor of the present invention includes a conventional simple idle system with an idle shutoff valve which functions when the engine has reached an operating temperature. The fuel shutoff valve is incorporated in the common connecting line of the separate fuel lines and the idle shutoff valve and fuel shutoff valve may be switched alternately depending on the operating temperature of the engine so that the idle shutoff valve opens above a predetermined operating temperature and turns on the idle system while the fuel shutoff valve is opened below this temperature and connects separate fuel lines as components of an idle system with enrichment on a start and warm up of the engine.

By virtue of the last-noted features of the invention, an alternative operation of a simple idle system in the carburetor for the warmed up engine and mixture forming system for starting and warming up the engine is provided. This makes use of the fact that, on the one hand, when the engine is warmed up, separation of the fuel-air mixture in an intake line heated by the coolant has hardly any distrubing effects and, on the other hand, there is no danger of fuel vapor formation in the separate fuel lines before the engine reaches its operating temperature. Thus, the separate fuel lines may be constructed and installed in a simple fashion without taking these factors into account, for example, by running the separate fuel lines through the intake manifold or simply by installing individual lines made of tubing or hose.

In accordance with yet still further features of the present invention, a separate air and fuel line is combined into a single injection nozzle with the lines projecting into an individual intake channel by means of a tip containing a mixture atomizing nozzle. The separate air lines are each provided with an air throttle nozzle and/or a one-way air valve in a connecting stub; whereas, the fuel lines are provided with a fuel throttle nozzle in a fuel connecting stub.

Accordingly, it is an object of the present invention to provide a carburetor for a multi-cylinder internal combustion engine which is simple in construction and therefore relatively inexpensive to manufacture.

Another object of the present invention resides in providing a carburetor for a multi-cylinder internal combustion engine which dispenses with the need for multiple control devices for mixing the fuel-air components.

Yet another object of the present invention resides in providing a carburetor for a multicylinder internal combustion engine and a method of operating the carburetor which enable the internal combustion engine to exhibit especially good fuel consumption, exhaust gas composition, and engine performance.

A further object of the present invention resides in providing a carburetor for a multicylinder internal combustion engine and a method of operating the carburetor wherein separate fuel lines are additionally used for enrichment of the fuel-air mixture to enable an enrichment for acceleration of the engine.

Another object of the present invention resides in providing a carburetor for a multicylinder internal combustion engine the overall construction of which contributes to a function which meets all requirements for operational characteristics of the engine such as uniform mixture formation in all of the individual intake pipes, therefore for all the cylinders of the engine to achieve a favorable fuel consumption and favorable exhaust gas composition as well without thereby entailing far higher construction costs of electrically or mechanically controlled fuel injection systems.

A still further object of the present invention resides in providing a carburetor for a multicylinder internal combustion engine which functions realiably under all operating conditions.

These and other objects, features, and advantages of the present invention will become more apparent from the following description when taken in connection with the accompanying drawings which show, for the purposes of illustration only, two embodiments in accordance with the present invention, and wherein.

Figure 1:
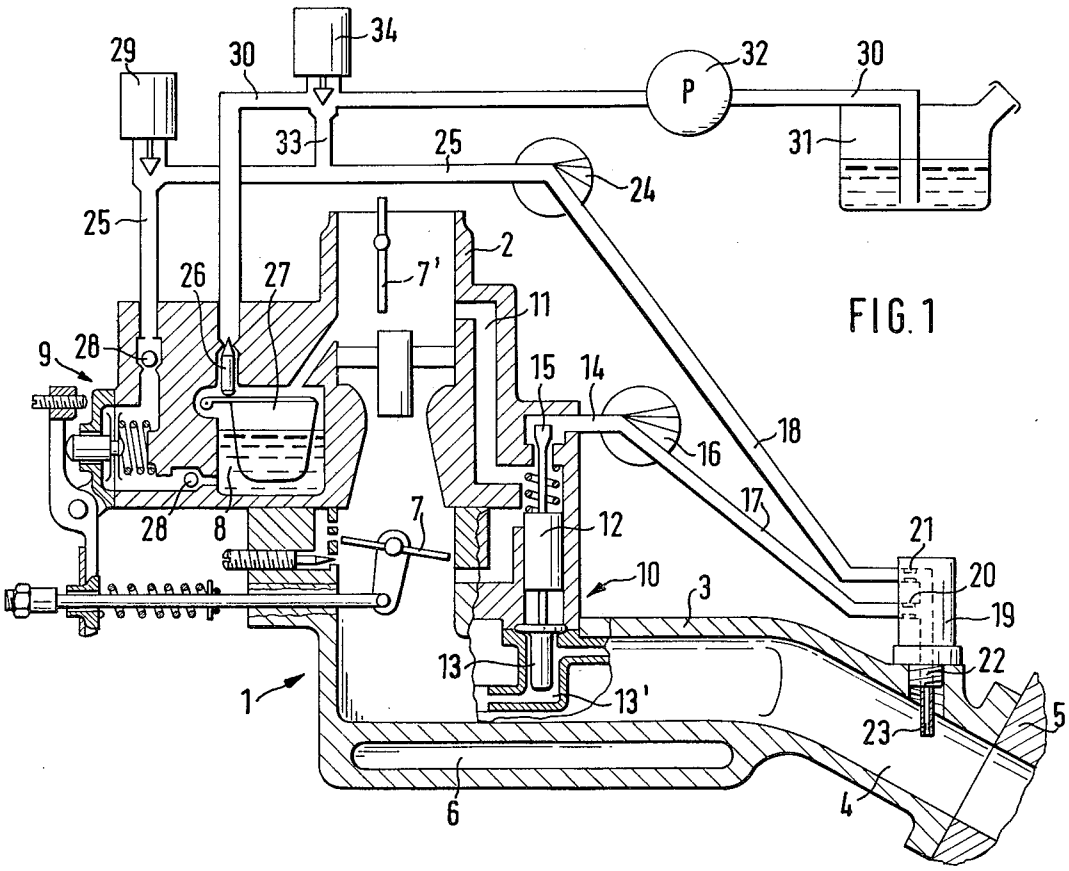
FIG. 1 is a partially schematic cross sectional view of a carburetor for a multicylinder internal combustion engine in accordance with the present invention.

Referring now to the drawings wherein like reference numerals are used throughout the various views to designate like parts and, more particularly, to FIG. 1, according to this Figure, a carburetor generally designated by the reference numeral 1 for a multicylinder internal combustion engine (not shown) includes a carburetor body 2 and an intake manifold 3 which is divided or broken down into individual intake branches or lines 4 flanged to a cylinder head 5 of the engine. The intake manifold 3 includes a heating chamber 6 on an underside thereof through which flows a coolant from the cooling system (not shown) of the internal combustion engine.

The carburetor 1 includes a throttle plate or valve 7, a choke plate 7', a float bowl 8, an accleration pump generally designated by the reference numeral 9 connected to the throttle plate 7, a cold start valve generally designated by the reference numeral 10 with a bypass channel 11, an air valve 12 and an expandable element 13 which is exposed to a coolant flowing through a line 13'. An air line 14, in the vicinity of the cold start valve 10, branches off from the bypass channel 11 before or upstream of the air valve 12 with the air line 14 being controlled by a correction air valve 15 which is moved together with the air valve 12 but which has an opposite controlling effect.

Figure 2:
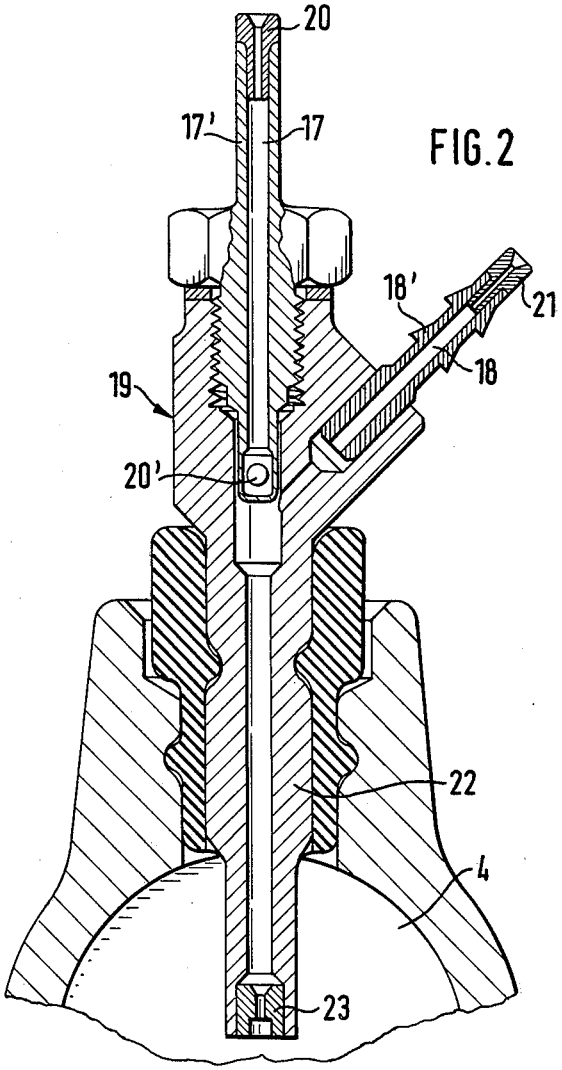
FIG. 2 is an enlarged cross sectional view of an injection nozzle for the carburetor of FIG. 1 installed in an individual intake pipe of the engine.

An air distributor 16 divides or distributes the air from the air line 14 into separate individual air lines 17 which extend from the air distributor 16 and eventually terminate together with a fuel line 18 in an injection nozzle 19 mounted at the respective individual intake lines 4. The injection nozzles 19, in addition to having the two intake lines, namely, the air line 17 and fuel line 18, has an air throttle jet or nozzle 20 and a fuel throttle jet or nozzle 21 and, at an end of the tip 22 thereof, a mixture atomizing jet 23. A oneway valve 20 (FIG. 2) constructed as, for example, a ball valve is located at the end of each of the respective air lines 17.

A fuel-collecting line 25 connects the float bowl of the carburetor 1 to the fuel distributor 24. The fuel distributor 24 distributes the fuel to the injection nozzles 19 by the individual fuel lines 18. The float bowl 8 is supplied with fuel in the usual manner with the fuel being at a zero pressure at a predetermined level controlled by a float valve 26 and a float 27. The acceleration pump 9, provided with two check valves 28, is connected in the fuel collecting line 25. Additionally, a fuel shutoff valve 29 is disposed in the fuel collector line 25, which may be used as an idle shutoff valve as a function of an ignition circuit of the engine. A connecting line 33 branches off from a fuel feed line 30 from a fuel tank 31. The fuel feed line 30 passes through a fuel pump 32, extends to the float bowl 8, and is controlled by the float valve 26. The connecting line 33 is selectively connectable with the fuel connecting line 25 by an additional fuel shutoff valve 34 in dependence upon an enrichment signal given, for example, by an accleration sensor switch (not shown).

During an operation of the internal combustion engine, when the ignition current is switched on, the fuel shutoff valve 29 is opened and, if it is also electrically operated by the ignition circuit, the fuel pump 32 begins operating. The predetermined fuel level is thus established in the float bowl 8. If the internal combustion engine is now started by an electrical starter (not shown) a suction pressure below ambient pressure is created in the individual intake lines 4 with the throttle valve 7 and/or the choke plate 7' closed. If the fuel pump 32 is mechanically operated, the starting of the internal combustion engine simultaneously produces the correct fuel level in the float bowl 8.

If the starting of the internal combustion engine takes place with a cold engine, the air valve 12 assumes a predetermined open position for the bypass channel 11 which position is a function of the ambient temperature. The correction air valve 15, coupled to the air valve 12, is more or less closed in the opposite direction of the air valve 12 in dependence upon the ambient temperature. Thus, in the cold condition of the engine, the air valve 12 has an appropriately larger aperture cross section and permits an appropriately larger volume of intake air to pass from the bypass channel 11 into the individual intake lines 4 so as to produce a ramming or charging effect on the engine which increases inversely with the engine temperature and directly with the power requirements for idling of the engine. On the other hand, the correction air valve 15 reduces the volume of correction air passing through the individual air lines 17 to the injection nozzles 19 as the engine temperature drops so that a volume of fuel is admitted from the individual fuel lines into the individual intake lines which is adjusted to the volume of intake air in the individual intake lines 4 thereby controlling the volume of fuel that enters the individual intake lines 4 from the injection nozzles 19.

After the engine is started, the expandable element 13 moves the air valve 12 further and further into a position which cuts off the bypass channel 11, as a function of the increasing temperature of the coolant. The movement of the air valve 12 causes a corresponding movment of the connected correction air valve 15 into a position which increasingly opens the air line 14 so that the volume of air flowing through the individual intake lines 4 and, consequently, the charging or ramming of the internal combustion engine are appropriately reduced in accordance with the co-efficient of friction of the engine, which decreases with rising operating temperature, while the volume of correction air for the injection nozzles 19 is increased thereby reducing the volume of fuel coming from the fuel lines 18 and continuously adjusting it to match the falling volume of intake air in the individual intake lines 4. The setting of the intake air volume, the correction air volume, and the fuel volume are achieved by an appropriate setting or adjusting of the air valves 12, 15, air and fuel throttle nozzles or jets 20, 21 and the mixture atomizing nozzles 23.

Accordingly, with the carburetor of the present invention, a system is created for supplying fuel exclusively through injection nozzles 19 for idle operation of the internal combustion engine from a cold start to a normal operating temperature so that precipitation of fuel from the fuel-air mixture in a vicinity of the intake manifold 3, with the disadvantages of irregular distribution of the individual cylinders of the engine, is prevented thereby attaining the advantageous results such as good engine performance, favorable fuel consumption, and favorable exhaust gas composition.

The fuel requirements for the internal combustion engine when operating under a load can be controlled in the usual fashion by the main and enrichment systems of the carburetor 1 itself. Additionally, the idle operation with the engine warmed up may also be maintained by heating the intake manifold 3 by means of the heating chamber 6 without disadvantages by empolying a conventional simple idle system in the carburetor 1. The fuel collector line 25 can then be shut off by the fuel shutoff valve 29. Additionally, when the engine is shut off the fuel shutoff valve 29 always acts as an idle shutoff valve by interrupting the ignition circuit thereby preventing an undesireable dieseling or runningon of the engine.

To provide enrichment during acceleration before the predetermined operating temperature of the engine has been reached, an additional amount of fuel can be supplied through the fuel-collector line 25 and fuel lines 18 to the individual intake lines 4 through the injection nozzles 19 by the accleration pump as a result of an opening movement of the throttle plate 7. This may also be accomplished by using a suitable electrical control to selectively operate an additional fuel shutoff valve 34 so that the feed pressure from the fuel pump 32 is directed into the fuel-collector line 25 and fuel lines 18, and the enrichment volume is determined exclusively by the dimensions of the fuel nozzles or jets 21 and/or by appropriate dimensioning of the connecting line 33. The one-way air valves 20 in the respective air lines 17 are provided to prevent the fuel from overflowing into the respective air lines 17.

In order to provide a carburetor construction which will be convenient to manufacture and easy to maintain, advantageously the cold start valve 10 with the air valve 12 correction air valve 15 and expandable element 13, as well as with the air distributor 16 may be combined to form a unit separate from the carburetor 1. The fuel distributor 24 may similarly be combined with the fuel shutoff valves 29, 34 to form a separate and rapidly replaceable unit.

The air and fuel lines 17, 18 may be integrated into the intake manifold 3 especially if fuel lines 18 are cut off by the shutoff valve 29 after the engine reaches its normal operating temperatures so that operating problems resulting from the formation of vapor bubbles in the fuel lines 18 are essentially eliminated. However, the air and fuel lines 17, 18 may also be installed separately from the intake manifold 3 whereby the fuel lines 18 and fuel-collector line 25 may be provided with heat insulation to avoid the formation of vapor bubbles.

Figure 3:
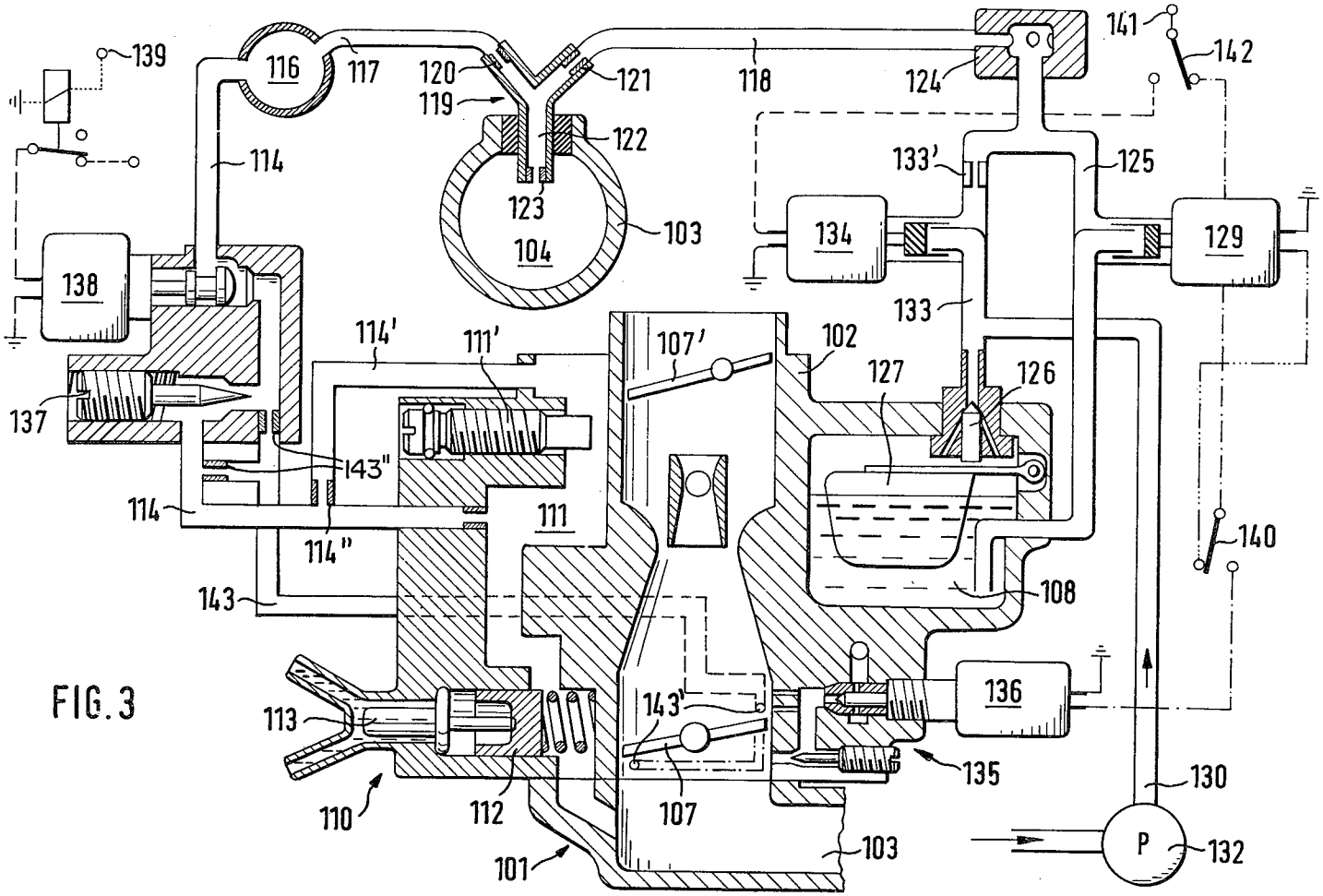
FIG. 3 is a partially schematic cross sectional view of another embodiment of a carburetor for a multicylinder internal combustion engine in accordance with the present invention.

As shown in FIG. 3, a carburetor generally designated by the reference numeral 101 is provided which has essentially the same constructional features as the carburetor 1 in FIG. 1. The carburetor 101 includes a carburetor body 102 and an intake manifold generally designated by the reference numeral 103 which is divided into individual intake branches or lines 104. In addition to a throttle plate 107 and a choke plate 107' as well as a float bowl 108, the carburetor 101 has a conventional idle system generally designated by the reference numeral 135 with an electric idle shutoff valve 136. A cold start valve generally designated by the reference numeral 110 with a bypass channel 111, an air valve 112, and an expandable element 113, exposed to the coolant of the engine cooling system, are disposed in the carburetor 101. The bypass channel 111 is additionally provided with an adjustable throttle means 111' on an input side thereof. An air line 114 branches off from the bypass channel 111 between the throttle means 111' and air valve 112, with an additional air line 114', having a throttle 114'', being connected with the air line 114. The additional throttled air line 114' branches off from the bypass channel 11 upstream of the throttle means 111'.

An additional adjustable throttle 137 and an air shutoff valve 138 are connected in the air line 114. The air shutoff valve 138 is controlled by a starter circuit 139 of the internal combustion engine. The air line 114 branches off into separate air lines 117 in an air distributor 116 with each of the separate air lines 117 terminating, together with separate fuel lines 118, in injection nozzles 119 mounted on the individual intake lines 104. Each of the injection nozzles 119 is provided with an air throttle nozzle or jet 120 for the air lines 117, a fuel throttle nozzle or jet 121 for the fuel lines 118, and a mixture atomizer 123 at each outlet tip 122 of the respective injection nozzles 119.

The fuel lines 118 extend from a fuel distributor 124 to the respective injection nozzles 119. The fuel distributor 124 is connected by a fuel collector line 125 to the float bowl 108 in the carburetor 101. The float bowl 108 includes a float valve 126 in the usual fashion with the float valve 126 being controlled by a float 127 to set a predetermined fuel level. The fuel collector line 125 contains a fuel shutoff valve 129 which is alternatively connectable with the idle shutoff valve 136 in the carburetor 101 by a selector switch 140 in the ignition circuit 141. The fuel collector line 125 is also connectable by a connecting line 133 with a throttle nozzle 133' and, by an additional fuel shutoff valve 134 contained therein, with fuel supply line 130 connected to a pressure side of the fuel pump 132. Additionally, the further fuel shutoff valve 134 is connectable to the ignition circuit 141 by an additional switch 142 which alternatively, on the one hand, controls the additional fuel shutoff valve 134 and, on the other hand, controls the idle shutoff valve 136 as well as the fuel shutoff valve 129.

An additional correction air line 143 is connected in the carburetor 101 in a direction of the air flow immediately up stream or downstream of the throttle valve 107 at a point 143' which is swept by the throttle valve 107. The additional correction air line 143 terminates, by throttle nozzles 143'', in the air line 114 upstream of the air distributor 116.

In contrast to the carburetor 1 of FIG. 1, in carburetor 101, the cold start valve 110 is provided exclusively with an air valve 112 for the bypass channel 111. The volume of correction air flowing through the air line 114 in this construction is determined solely by the air valve 112 with the aid of the adjustable choke 111' in the following manner.

With the coolant of the engine cooling system at a low temperature, i.e. with a cold engine, a larger opening of the air valve 112 is caused by the expandable element 113 and an especially low suction pressure is created in the bypass channel 111. The low suction pressure prevents or at least minimizes an overflow of correction air through the air line 114, air distributor 116, and air lines 117 as well as the injection nozzles 119 into the individual intake lines 104. The portion of the fuel which is thereby sucked into the individual intake lines 104 under the influence of the equally low pressure in the individual intake lines 104 through the injection nozzles 119 from the fuel lines 118, fuel distributor 124, fuel collector line 125 and float bowl 108 is relatively large. This corresponds to the relatively large opening of the air valve 112 and the consequently relatively large volume of the intake air flowing through the bypass channel 111. As the operating temperature rises and therefore the opening of the air valve 112 steadily decreases, the pressure in the bypass channel 111 rises so that the volume of correction air flowing through the air line 114 and air lines 117 rises simultaneously so that the fuel volume from the fuel lines 118 decreases accordingly. In this manner, the correction air is adjusted to the volume of the intake air from the bypass channel 111 which is reduced by the air valve 112.

Therefore, until a predetermined operating temperature of the engine is reached, the engine at idle speed receives most of the intake air through the intake manifold 103 and receives the amount of fuel corresponding to the total intake air at idle speed through the intake nozzles 119, with correction air added, if necessary, without the danger of the fuel-air mixture separating in the intake manifold 103 which would result in irregular operation of the engine or excessive fuel consumption to compensate for the irregular fuel-air mixture distribution.

To adjust the exact volumes of the intake air and correction air to the exact requirements of the individual engine and its overall functioning state, adjustable throttle 111' and setting throttle 137 are provided. The tuning air line 114', with the various air throttle nozzles in the air lines 114, 114' and 117 likewise serve for fine tuning of the volume of correction air thereby determining the amount of fuel appropriate for the charging or ramming of the engine.

For enriching the fuel-air mixture during cold starts, air shutoff valve 138 is located in the air line 114 to shutoff the correcting air and thereby to increase the volume of fuel sucked in through the fuel lines 118. The air shutoff valve 138 shuts off the air line 114 during a starting operation of the engine possibly with a time delay.

The fuel shutoff valve 134 is used to enrich the fuel-air mixture with fuel during operation. The fuel shutoff valve 134 alternately with fuel shutoff valve 129 produces a connection between the fuel supply line 130 and the fuel distributor 124 and therefore with fuel lines 118 and injection nozzles 119, valve by means of the selector switch 142 as a function of an enrichment signal from, for example, an acceleration sensor (not shown) through connecting line 133 with a fuel choke 133'. In this manner, fuel is supplied by the fuel pump 132 in an amount determined by the throttle nozzles 133', 121 into the individual intake pipes 104. The float bowl 108 is prevented from overflowing by shutting off fuel intake line 125 by means of the fuel shutoff valve 129.

Further enrichment for certain load range operations of the internal combustion engine or rotational positions of the throttle plate 107 is accomplished by means of the additional correction air line 143. Depending upon the location of the point 143' of its connection to the throttle plate 107, either correction air is drawn through the latter into the suction line 103 from the correction air line 114, i.e., the position 143' located downstream of the throttle plate 107, or additional correction air is supplied from the carburetor 101 to the correction air line 114, i.e., position 143' upstream of the throttle plate 107. In the former case enrichment takes place with the throttle plate 107 closed and decreases after the plate 107 opens by changing the suction pressure at the point 143'. In the latter case, enrichment begins when the throttle plate 107 sweeps over the position 143' resulting in enrichment under partial load conditions.

The fuel shutoff valve 129 is closed by the switch 140, with the switch 140 being controlled as a function of the operating temperature of the engine or the temperature of the engine coolant, even when a predetermined operating temperature is exceeded, alternately with an idle shutoff valve 136 in the carburetor 102. In this manner, the supply of fuel to the injection nozzles 119 is cut off above the predetermined operating temperature of the engine and, consequently, before any danger is created of the formation of fuel vapor bubbles in the fuel collector line 125 and in the individual fuel lines 118. At the same time, since there is no longer any danger just above this operating temperature, that the idle mixture will separate into the intake manifold 103 heated by the coolant of the cooling system, reliable function with the engine operating at idle is ensured by the idle system 135 in the carburetor 101. Moreover, there is no need for additional enrichment on acceleration of the internal combustion engine through the injection nozzles 119 as this is ensured by keeping the two fuel shutoff valves 129, 134 closed.

The simple design of both the warm up control 110 and the idle system 135 in the carburetor 101, in addition to producing the advantageous overall functioning of the carburetor 101, offer the additional advantage of a particularly simple and economical design for the carburetor 101 itself so that the constructional costs for the additional correction air lines 117 and fuel lines 118 as well as their control elements can partially be offset by the simplified design of the carburetor 101 itself.

While I have shown and described only two embodiments in accordance with the present invention, it is understood that the same is not limited thereto but is susceptible of numerous changes and modifications as known to one having ordinary skill in the art, and I therefore do not wish to be limited to the details shown and described herein, but intend to cover all such modifications as are encompassed by the scope of the appended claims.

I claim:

1. A method of carburetion for a multicylinder internal combustion engine, the method comprising the steps of:

forming a main fuel-air mixture in at least one carburetor;

guiding the main fuel-air mixture through individual intake lines which connect the at least one carburetor to intake valves of the engine;

guiding further mixture components through separate air lines and fuel lines which terminate in the individual intake lines; and combining the separate air lines and fuel lines prior to an introduction into the respective intake lines, the method being characterized by:

supplying intake air to further mixture components primarily through the individual intake lines;

guiding a volume-controlled portion of the intake air through the separate air lines to these mixture components as correction air for the fuel flowing through the separate fuel lines;

commonly controlling the volume of the correction air flowing through all of the air lines by a control means;

disposing the common control means upstream of an air distributor means for all of the air lines; and commonly feeding fuel to the separate fuel lines at zero pressure from the at least one carburetor to individual inlets in the intake lines through a fuel throttle nozzle located in a vicinity of the individual inlets.

2. A method according to claim 1, further characterized by:

shutting off a zero pressure fuel supply from the at least one carburetor as a function of an enrichment signal; and at the same time supplying fuel to the individual inlets in the intake lines under a pressure from a fuel pump.

3. A carburetion arrangement for a multicylinder internal combustion engine, the arrangement comprising at least one carburetor for forming a main fuel-air mixture, individual intake channel means for connecting the at least one carburetor to intake valves of the internal combustion engine, and separate air line means and fuel line means for respectively delivering air and fuel to the intake channel means, characterized in that control means, controlled as a function of volume, are provided for commonly distributing intake air for fuel-air mixture components formed by the separate air line means and fuel line means to the individual intake channel means, at least one additional control means is provided for controlling a small portion of the intake air, said additional control means is operable to control the intake air to the separate air line means as a fuel correction and as a function of volume with a volume of the fuel correction air being reduceable to zero, said additional control means is disposed upstream of an air distributor means for distributing air to the separate air lines means, and in that fuel distributor means are provided for distributing fuel to the separate fuel line means, said fuel distributor means are connected at zero pressure to the at least one carburetor means.

4. A carburetion arrangement according to claim 3, characterized in that the first mentioned control means is a cold start valve and said additional control means is a correction air valve, said cold start valve is adapted to increasingly open a control cross section of the correction air valve in dependence upon a rise in operating temperature of the internal combustion engine.

5. A carburetion arrangement according to claim 4, characterized in that the first mentioned control means includes an additional air valve, said additional air valve is adapted to increasingly throttle a control cross-section as the operating temperature of the internal combustion engine rises, and in that said additional air valve acts as a control device for a volume of intake air supplied to the individual channel means.

6. A carburetion arrangement according to claim 3, characterized in that the control means and additional control means are formed as a cold start valve disposed in the carburetor, the cold start valve includes a bypass channel, a throttle means disposed in the bypass channel in an area of an intake portion thereof, and a single air valve means for increasingly throttling a control cross section in the bypass channel in a vicinity of a throttle plate of the carburetor as an operating temperature of the internal combustion engine rises, and in that a branch line means is provided for communicating the cold start valve with the air line means, said branch line means is arranged at the cold start valve between the throttle means and the single air valve means.

7. A carburetion arrangement according to claim 6, characterized in that an air channel means extends from an inlet of the bypass channel means to the branch line means, and in that a throttle means is disposed in the air channel means.

8. A carburetion arrangement according to claim 7, characterized in that an inlet of said air channel means is disposed in parallel to an inlet of the bypass channel means.

9. A carburetion arrangement according to one of claims 6, 7, or 8, characterized in that at least one additional air line means is provided for supplying correction air, said additional air line means terminates at a position upstream of the distributor means, said additional air line means is adapted to be connected to the carburetor at a position at least one of upstream or downstream of a throttle plate of the carburetor so as to enable a terminal opening of the additional air line means to be swept by the throttle plate.

10. A carburetion arrangement according to claim 9, characterized in that a further control means is disposed between the cold start valve and the separate air line means.

11. A carburetion arrangement according to claim 10, characterized in that the further control means is an adjustable throttle means.

12. A carburetion arrangement according to claim 11, characterized in that an air shutoff valve means is disposed between the cold start valve and the separate air line means, said air shutoff valve means being adapted to be operated by an electrical circuit of a starter of the internal combustion engine.

13. A carburetion arrangement according to claim 12, characterized in that the air shutoff valve means is arranged between the adjustable throttle means and the air distributor means.

14. A carburetion arrangement according to claim 12, characterized in that a common fuel line is disposed between the fuel distributor means and a pressure side of a fuel pump, a fuel shutoff valve means is arranged in the common fuel line, an additional fuel shutoff valve means is arranged in the common fuel line and the first-mentioned fuel shutoff valve means, and in that means are provided for alternately actuating the fuel shutoff valve and the additional fuel shutoff valve in dependence upon a position of an enrichment switch.

15. A carburetion arrangement according to claim 14, characterized in that the carburetor includes an idle system having an idle shutoff valve means, the idle shutoff valve means is operable to control an operation of the idle system upon the internal combustion engine reaching a predetermined operating temperature, means are provided for alternately switching the idle shutoff valve means and the first mentioned fuel shutoff valve means is dependence upon the operating temperature of the engine whereby the idle shutoff valve means opens above the predetermined operating temperature so as to turn on the idle system and the first-mentioned fuel shutoff valve means is opened below the predetermined operating temperature so as to connect the fuel line means as components of the idle system with enrichment upon a starting and warm up operation of the internal combustion engine.

16. A carburetion arrangement according to claim 3, characterized in that an acceleration pump is operatively connected to a throttle plate of the carburetor.

17. A carburetion arrangement according to claim 16, characterized in that a common fuel line is disposed between the fuel distributor means and the carburetor, and in that the acceleration pump is connected to the common fuel line.

18. A carburetion arrangement according to claim 16, characterized in that the acceleration pump is connected in parallel to the common fuel line.

19. A carburetion arrangement according to claim 3, characterized in that means are provided for combining the respective air line means and respective fuel line means prior to an introduction into the individual intake channel means.

20. A carburetion arrangement according to claim 19, characterized in that the combining means is formed as an injection nozzle projecting into the individual intake channel means, the respective injection nozzles each include a tip having a mixture atomizer means disposed therein, an air connecting means is provided for connecting the respective injection nozzles with an associated separate air line means, a fuel connecting means is provided for connecting the respective injection nozzles with an associated separate fuel line means, and in that at least one of an air throttle means and a one way air valve is disposed in one of the air connecting means and the fuel connecting means.

21. A carburetion arrangement according to claim 3, characterized in that a further control means is provided between the first-mentioned control means and the air distributor means.

22. A carburetion arrangement according to claim 21, characterized in that the further control means is constructed as an adjustable throttle means.

23. A carburetion arrangement according to claim 21, characterized in that the further control means is an air shutoff valve means provided between the first mentioned control means and the air distributor means, the air shutoff valve means is adapted to be controlled by an electrical circuit means of a starter of the internal combustion engine.

24. A carburetion arrangement according to claim 23, characterized in that a fuel shutoff valve means is disposed in a fuel collecting line leading to the fuel distributor means, the fuel collecting line is connected to a pressure side of a fuel pump means, an additional fuel shutoff valve means is arranged in the fuel collecting line between the fuel pump means and the first-mentioned fuel shutoff valve, and in that the two fuel shutoff valve means are adapted to be alternately actuated in dependence upon a positioning of an enrichment switch.

25. A carburetion arrangement according to claim 3, characterized in that the carburetor includes an idle system having an idle shutoff valve means for controlling an operation of the idle system upon the internal combustion engine reaching a predetermined operating temperature, a fuel shutoff valve means is incorporated in a common connecting fuel line which communicates with the separate fuel line means, means are provided for alternately switching the idle shutoff valve means and the fuel shutoff valve means in dependence upon the operating temperature of the engine whereby the idle shutoff valve means opens above the predetermined operating temperature so as to turn on the idle system and the fuel shutoff valve means is opened below the predetermined operating temperature so as to connect the separate fuel line means as components of the idle system with enrichment on start and warm up operations of the internal combustion engine.

* * * * *